US006799436B1

(12) United States Patent
Minassian

(10) Patent No.: US 6,799,436 B1
(45) Date of Patent: Oct. 5, 2004

(54) ADJUSTABLE AND LINKABLE JEWELRY DEVICE

(76) Inventor: Leon Minassian, 460 Henley Ave., New Milford, NJ (US) 07646

( * ) Notice: Subject to any disclaimer, the term of this patent is extended or adjusted under 35 U.S.C. 154(b) by 119 days.

(21) Appl. No.: 10/155,386

(22) Filed: May 24, 2002

(51) Int. Cl.[7] ..... A44C 5/00; A44C 9/02

(52) U.S. Cl. ..... 63/3.2; 63/3.1; 63/9; 63/15.65; 24/70 J; 24/69 J

(58) Field of Search ..... 63/3, 3.1, 3.2, 63/9, 15.65; 24/71 J, 70 J, 69 J, 265 WS

(56) References Cited

U.S. PATENT DOCUMENTS 312,994 A * 2/1885 Heilborn ..... 24/163 R
1,591,295 A * 7/1926 Donaldson ..... 24/596.1
1,641,372 A * 9/1927 Chilson ..... 24/71 R
1,703,490 A * 2/1929 Katz ..... 24/70 J
1,997,723 A * 4/1935 Franklin, Jr. ..... 24/71 J
1,997,724 A * 4/1935 Franklin, Jr. ..... 24/574.1
2,425,477 A * 8/1947 Larson ..... 63/3
2,491,977 A * 12/1949 Heller ..... 24/71 J
2,536,146 A * 1/1951 Wiese ..... 63/3
2,588,655 A * 3/1952 O'Neill ..... 24/71 J
2,613,415 A * 10/1952 Ritter ..... 24/71 J
3,042,277 A * 7/1962 Stradella ..... 24/68 R
3,404,440 A * 10/1968 Weiss ..... 24/601.5
3,478,537 A * 11/1969 Goldberine et al. ..... 63/4
3,574,903 A * 4/1971 Namiki ..... 24/265 WS
3,863,299 A * 2/1975 Hocq ..... 24/71 J
5,007,252 A * 4/1991 Mochizuki ..... 63/3
5,689,867 A * 11/1997 Katz ..... 24/587.1
6,085,550 A * 7/2000 Ishida ..... 63/15.65
6,470,708 B1 * 10/2002 Green ..... 63/3.2

* cited by examiner

*Primary Examiner*—Robert J. Sandy
*Assistant Examiner*—Katherine Mitchell
(74) *Attorney, Agent, or Firm*—Levisohn, Berger & Langsam LLP

(57) ABSTRACT

A linkable jewelry device is provided having a male clasp section and a female clasp section at opposite ends of the device. The female clasp section is adjustably retainable by the male clasp section. A plurality of longitudinal inflexible sections are interleaved with and hingedly attached to a plurality of connectors. When the female clasp section is retained by the male clasp section, the device forms an adjustable ring for wearing on a finger. The male clasp section has a number of notches into which a crossbar of the female clasp section may be selectively retained. The ring may be adjusted in diameter depending upon which notch retains the crossbar. Two or more devices may be linked together to form an adjustable-length bracelet or necklace.

7 Claims, 2 Drawing Sheets

ADJUSTABLE AND LINKABLE JEWELRY DEVICE

BACKGROUND OF THE INVENTION

1. Field of the Invention

The invention is related to jewelry, and more specifically to linkable jewelry articles that can form closed loops of jewelry such as rings, bracelets, or necklaces.

2. Description of Related Art

Jewelry is frequently made in a closed loop so that it may be worn around a part of the body; a ring is worn around a finger or toe, a bracelets is worn around a wrist or ankle, and a necklace is worn around a neck. That the article is a closed loop assists in it remaining on the wearer.

It can be difficult to find a comfortable or preferred size of a closed loop article of jewelry. In the case of rings, sizes are not infinitely variable and only change in half-size increments. Bracelets and necklaces are typically sold in specific lengths in multiples of inches. Adjusting conventional jewelry requires the intervention of a jeweler and cannot be performed by the ordinary consumer. It is desirable to provide jewelry which may be adjustable in size easily by the consumer.

U.S. Pat. No. 4,400,932 to Epstein describes a modular jewelry link has a closed loop at one end and a U-shaped deformable hook at the other. The hook of one link may be inserted into and crimped around the loop of an adjacent link. In this way, bracelets or necklaces of varying sizes can be manufactured. However, once one link is crimped together with another link, the links are somewhat permanently attached; repeated opening and crimping of a hook will cause metal fatigue, and it will ultimately snap off. Thus, the length of a bracelet or necklace can be changed at manufacture, but not at the whim of the consumer. Further, the length of the overall article can only be incremented or decremented by whole link lengths and by adding or subtracting links. A very small change in overall length—smaller than one link length—is impossible. If the length is to be increased, the consumer must purchase additional links, if she can find matching links. Lastly, the links are not designed to be usable to form a finger or toe ring.

SUMMARY OF THE INVENTION

Accordingly, it is an object of the invention to provide a linkable jewelry device that can be used as a ring.

It is another object of the invention to provide a linkable jewelry device that can be linked to other identical or similar devices to form a bracelet or necklace.

It is another object of the invention to provide a linkable jewelry device that can be linked to or unlinked from other identical or similar devices easily by a consumer.

The above and other objects are fulfilled by the invention, which is a linkable jewelry device. The device has a male clasp section and a female clasp section at opposite ends. The female clasp section is adjustably retainable by the male clasp section. A plurality of longitudinal inflexible sections are interleaved with and hingedly attached to a plurality of connectors. When the female clasp section is retained by the male clasp section, the device forms an adjustable ring for wearing on a finger. The male clasp section has a number of notches into which a crossbar of the female clasp section may be selectively retained. The ring may be adjusted in diameter depending upon which notch retains the crossbar. Two or more devices may be linked together to form an adjustable-length bracelet or necklace.

DETAILED DESCRIPTION OF THE PREFERRED EMBODIMENTS

Description of the invention will now be given with reference to the attached FIGS. 1–4. It should be noted that these figures are merely exemplary in nature and in no way serve to limit the scope of the invention, which is defined by the claims appearing hereinbelow.

Figure 1:
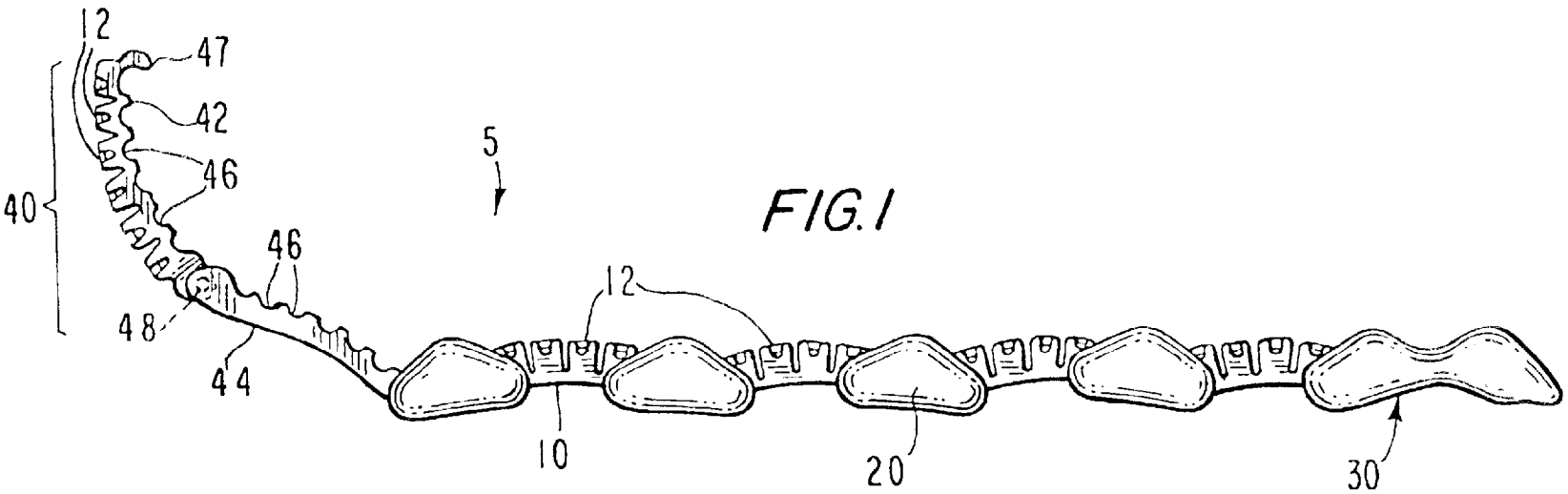
FIG. 1 is a side elevation view of a preferred embodiment of the invention.
Figure 2:
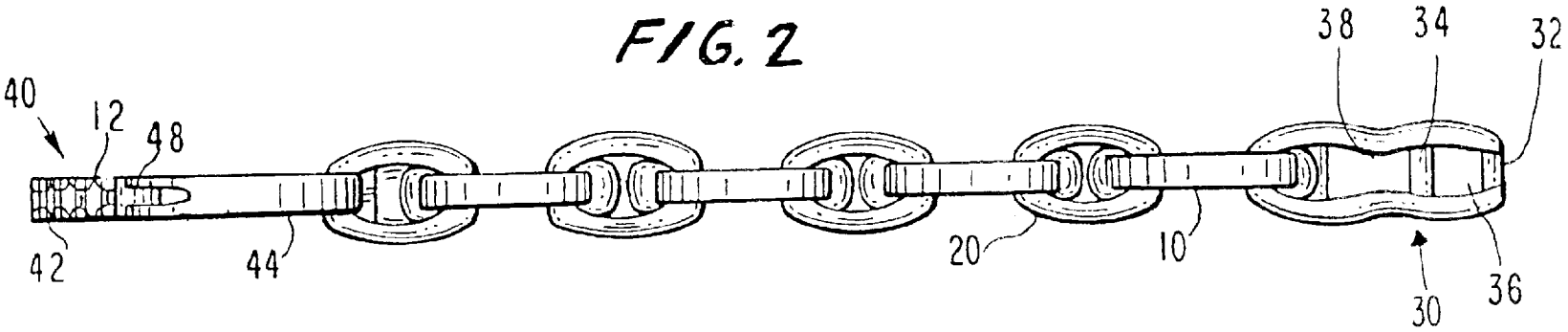
FIG. 2 is a rear elevation view of the embodiment of FIG. 1.
Figure 3:
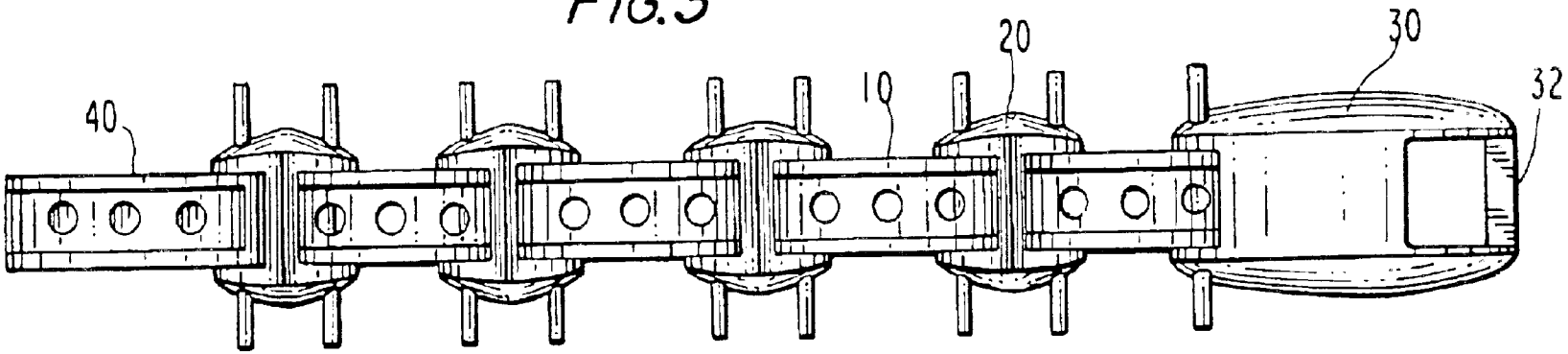
FIG. 3 is a top elevation view of an alternate embodiment of the invention.
Figure 4:
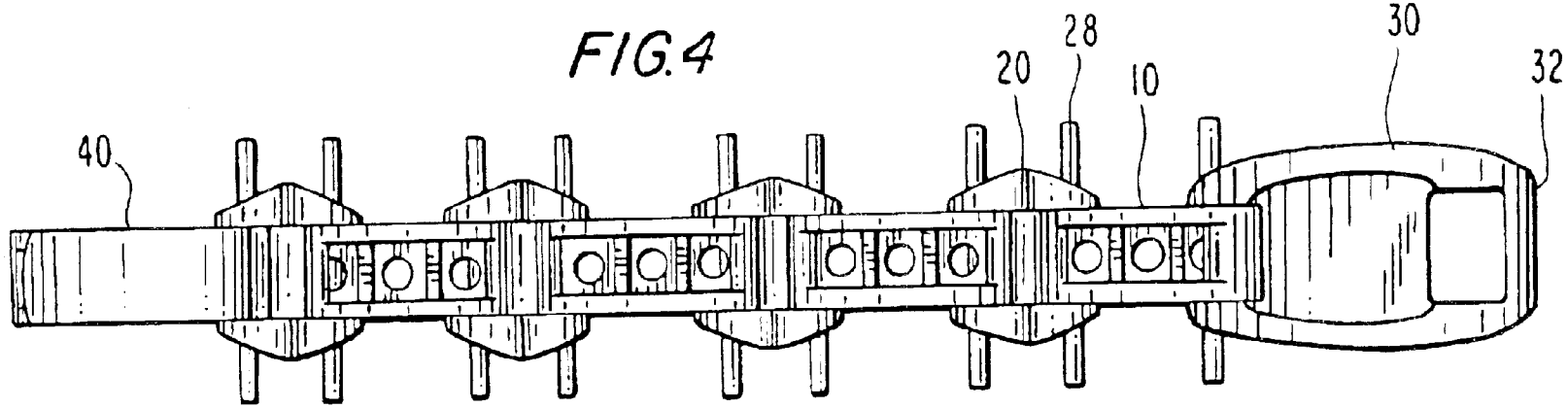
FIG. 4 is a rear elevation view of the alternate embodiment of FIG. 3.

Jewelry article 5 includes ornamental sections 10 interspersed with hinged sections 20. In the embodiment shown, ornamental sections 10 are provided with gemstones 12, however the ornamental sections could also be solid metal, or any other material from which jewelry is typically made. Ornamental sections 10 are preferably inflexible but are hingedly attached to adjacent hinged sections 20. As shown in FIG. 4, ornamental sections 10 may be attached at their ends by pins 28 to hinged connector sections 20. Pins 28 of FIG. 4 protrude from the sides of hinged connector sections 20, however they need not. As shown in FIGS. 1 and 2, the preferred embodiment has hinges that are unseen by the consumer.

At one end of article 5 is a female clasp section 30, and at the other, a male clasp section 40. Clasp sections 30 and 40 are preferably hingedly attached to either hinged connector sections 20 or ornamental sections 10. Female clasp section 30 includes a distal crossbar 32 which gets retained by male clasp section 40. A central crossbar 34 may be provided to form two apertures 36 and 38. Male clasp section 40 includes a clamping section 42 hingedly attached to a notched section 44 having notches 46 at hinge 48. A top surface of clamping section 42 is provided with an ornamental appearance or element. In FIGS. 1 and 2, it is provided with gemstones 12. However, the ornamental surface or element could also be metal or any other material from which jewelry is typically made. A free end of clamping section 42 is provided with a locking tooth 47 which can be locked to notched section 44.

In order to lock the device, clamping section 42 is passed through aperture 36 of female clasp section 30. Crossbar 32 may be positioned in any of notches 46 on notched section 44. Locking tooth 47 is snapped down on the corresponding end of notched section 44, and the device is locked in a loop. If the crossbar 32 is retained in a notch 46 removed from hinge 48, the ornamental surface of clamping section 42 (in this case, diamonds) is visible through aperture 38. This gives the visual impression of an ornamental surface completely encircling the device 5; thus, the device, when closed upon itself, can be worn as a ring. Preferably, the device 5 is approximately 2.5 inches long (with the clamping section closed over the notched section). As such, it is adjustable to form a ring of sizes 4–9.

The linkable jewelry device of the invention is not limited to use as a ring. Multiple of such devices can be linked together to form a bracelet, anklet, necklace, or similar article. Linking several devices 5 together is accomplished in substantially the same way as closing one device to form a ring. A male clasping section 40 of one device 5 is closed around the crossbar 32 of another device in the same manner as described above. Because each clasping section interface between adjacent linking devices is adjustable, the overall length of the article is extremely adjustable. In another variation, several devices 5 may each be closed upon itself to form interlocking rings, which may be used in a variety of different ornamental applications.

An advantage of the inventive device is that a jeweler is not required to adjust the sizing of a ring made from a single device 5, nor is a jeweler required to remove or add devices 5 to convert a ring to a bracelet or necklace or vice versa. The flexibility of use of the invention is directly enjoyable by the ultimate consumer and wearer of the jewelry so constructed.

Having described the invention with reference to the attached drawings, it is to be understood that various modifications to the invention that are within the ordinary skill of the artisan are contemplated as falling within the scope of the instant invention, which is defined by the claims appearing hereinbelow.

What is claimed is:

1. A linkable jewelry device, comprising:

a male clasp section comprising at least two longitudinally spaced notches, a hinged locking tooth and a locking tooth engaging end, said male clasp section being located at a first end of said device;

a female clasp section at a second opposite end of said device, said female clasp section having a cross bar capable of being retainable in any one of said notches of said male clasp section;

a plurality of inflexible gem supporting and displaying sections attached between said male and female clasp sections; and a plurality of hinged connectors connected to each end of said inflexible sections, so that said inflexible sections are hingedly attached to one another, wherein when said female clasp section is retained by said male clasp section said device forms an adjustable ring for wearing on a finger or toe said device further capable of joining together with other like devices to form a necklace or bracelet.

2. A linkable jewelry device according to claim 1, said female clasp section further comprising an aperture near said crossbar.

3. A linkable jewelry device according to claim 2, said male clasp section further comprising at least one ornamental element disposed on the visible surface of said male clasp section, wherein when said crossbar of said female clasp section is retained by said male clasp section, said at least one ornamental element is visible through said aperture.

4. A linkable jewelry device comprising one or more devices as claimed in claim 1, wherein each of said female clasp sections of a first of said linkable jewelry devices are retained by the adjacent male clasp section of a different linkable jewelry device.

5. A linkable jewelry device according to claim 4, wherein when said female clasp sections of said linkable jewelry devices are retained in said male clasp sections of said adjacent linkable jewelry device, all of said devices form a bracelet.

6. A linkable jewelry device according to claim 4, wherein linking said linkable jewelry devices forms a necklace.

7. A linkable jewelry device according to claim 4, wherein when said female clasp section of said first linkable jewelry device is retained by said male clasp section of said adjacent linkable jewelry device, said devices form an adjustable-length bracelet.

* * * * *